US005331734A

United States Patent [19]

Hunt

[11] Patent Number: 5,331,734

[45] Date of Patent: Jul. 26, 1994

[54] METHOD FOR INSTALLING AN ELECTRICAL DEVICE HAVING PINS INTO PIN SOCKETS

[76] Inventor: Arthur R. Hunt, 28 Salem Walk, Milford, Conn. 06460

[21] Appl. No.: 972,985

[22] Filed: Nov. 10, 1992

Related U.S. Application Data

[63] Continuation-in-part of Ser. No. 749,142, Aug. 22, 1991, abandoned, which is a continuation of Ser. No. 492,106, Mar. 12, 1990, abandoned.

[51] Int. Cl.[5] ..... H01R 43/16

[52] U.S. Cl. ..... 29/879; 313/49; 313/51; 362/382

[58] Field of Search ..... 29/825, 874; 313/49, 313/51; 362/382

[56] References Cited

U.S. PATENT DOCUMENTS

| | | | |
|---|---|---|---|
| 2,918,644 | 12/1959 | Fulton et al. . | |
| 2,924,702 | 2/1960 | Block | 240/51.11 |
| 3,697,802 | 10/1972 | Demas | 315/65 |
| 3,842,387 | 10/1974 | Santangelo . | |
| 4,275,325 | 6/1981 | Guim | 313/51 |
| 4,695,768 | 9/1987 | Covington et al. . | |

*Primary Examiner*—Carl J. Arbes
*Attorney, Agent, or Firm*—CTC & Associates

[57] ABSTRACT

A method for the nonvisible location of pin connectors of cylindrical multi-pin electrical devices in orientation with pin sockets for insertion of the connector pins into the pin sockets to make electrical contact.

3 Claims, 3 Drawing Sheets

FIG. 1
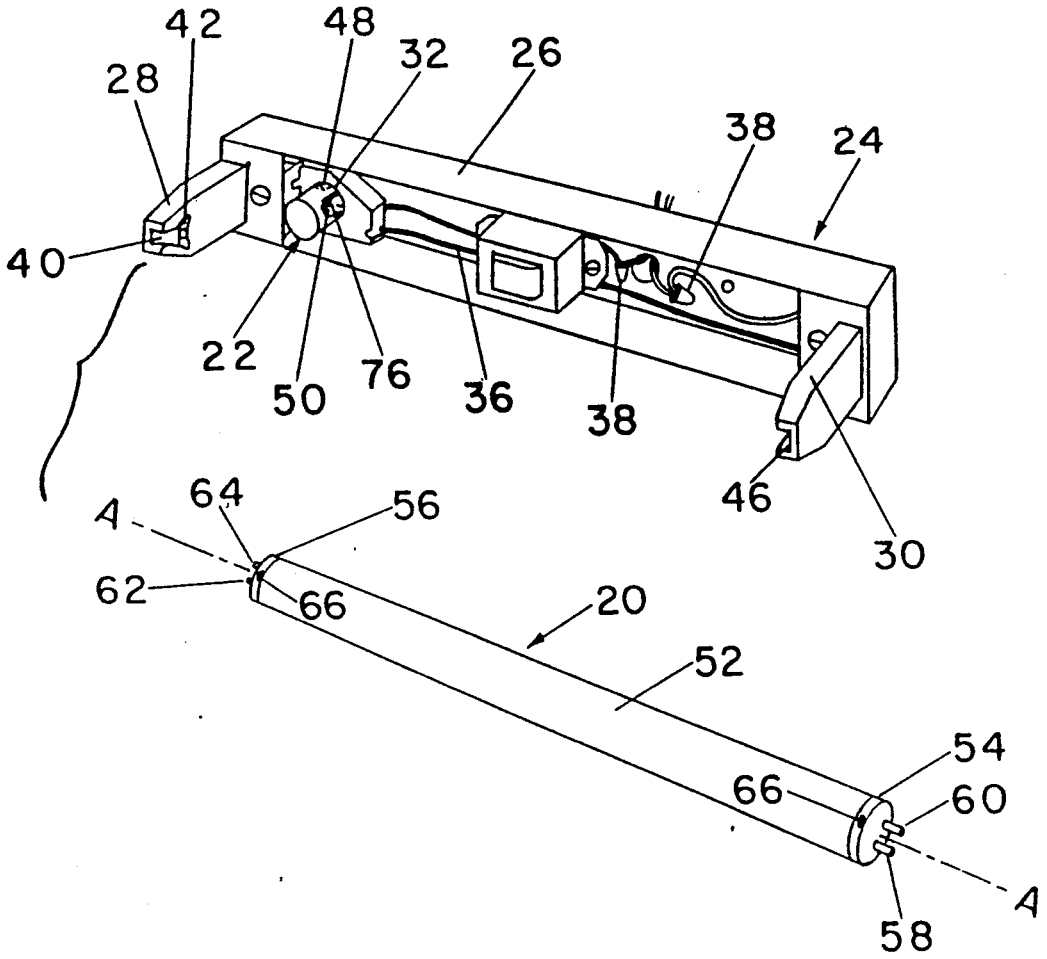
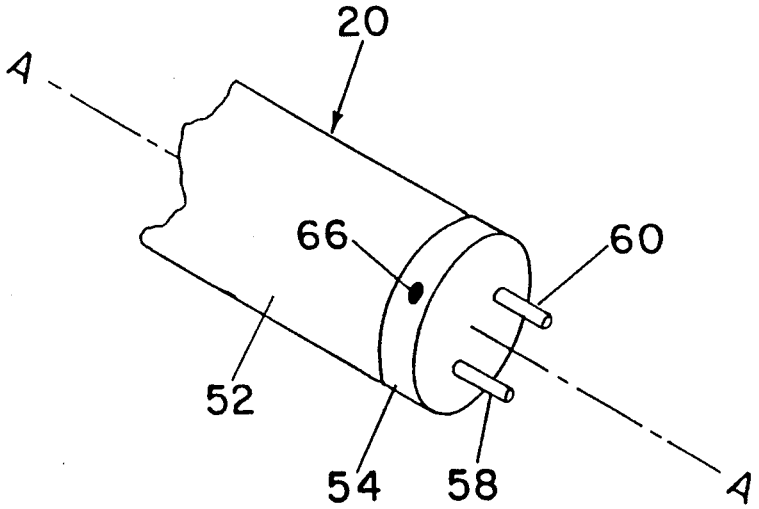
FIG. 2

FIG. 1A
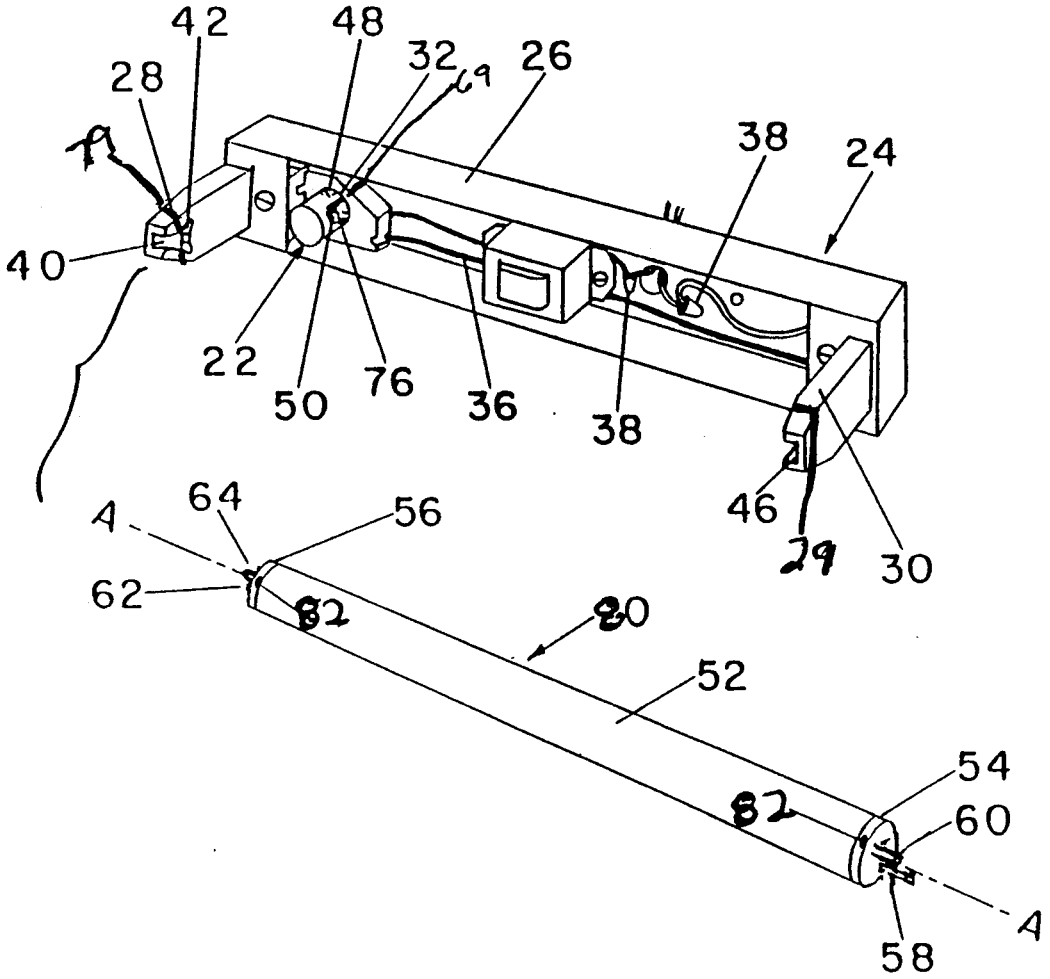
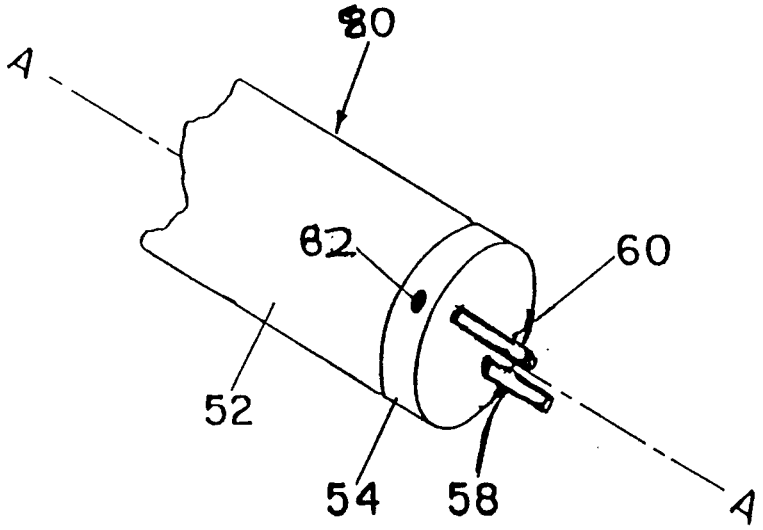
FIG. 2A

METHOD FOR INSTALLING AN ELECTRICAL DEVICE HAVING PINS INTO PIN SOCKETS

This is a continuation in part of a continuation filed Aug. 22, 1991 Ser. No. 07/749,142 of the original application Entitled Alignment Indicators For Cylindrical Devices, now abandoned and Ser. No. 07/492,106 filed on Mar. 12, 1990 entitled Alignment Indicators For Cylindrical Devices, now abandoned.

BACKGROUND OF THE INVENTION

The present invention relates to a method for the simple sensible installation of fluorescent tubes, starters for the same and the like wherein installation requires the nonvisible rotation of the cylindrical device about their axis to effect the required electrical contact of pin connectors into the connecting structure.

Fluorescent tubes are one example of pin connecting cylindrical electrical devices which are notoriously frustrating to today's householder to properly install and connect since most fluorescent lamps are ceiling or under cabinet mounted requiring the installer to work nonvisibly, relying on a sense of feel to first align the pins in proper parallel orientation to the lineal pin socket, inserting the ends of the fluorescent tube in orientation to the lineal socket, pressing the oriented pins into the socket and finally rotating the tube 90° about its axis to complete the circuit and lock it in place. This is particularly true for longer tubes within it is not possible to simultaneously orient the pins of both ends by feel. Industry is aware of the problem as is shown by the recent commercial introduction of fluorescent socket and tubes which have only one pin or pole on either end of a long (8 ft.) fluorescent tube completing the electrical circuit end to end.

OBJECT OF THE INVENTION

It is an important object of the instant invention to provide a simple sensible installation of fluorescent tubes and the like wherein it is necessary to align multiple pins in orientation with pin sockets then rotation of the cylindrical device about its axis to be captured by retaining mechanism in the socket and to make electrical contact.

PRIOR ART

A patentability search and results of the examination of the original application hereon revealed the following United States patents:

| U.S. Pat. No. | Date | Inventor |
|---|---|---|
| 2,918,644 | December 22, 1959 | Fulton |
| 2,924,702 | February 9, 1960 | Block |
| 3,697,802 | October 10, 1972 | Demas |
| 3,842,387 | November 15, 1974 | Santangelo |
| 4,275,325 | June 23, 1981 | Guim |

Fulton describes the basic construction of a directional fluorescent tube which permits positive direction of light eminating therefrom by use of a directional window whose position may be established by an offsetting indicator.

Block describes an easily installed adjustable fluorescent light fixture.

Demas is a two-color indicator lamp assembly capable of providing light signals of different colors.

Santangelo describes a two part spark plug adapter which includes visible or mechanical means to numerically clearly indicate the firing sequence of an automobile engine.

Guim relates to a fluorescent lamp of increased life, achieved by providing in one tube a plurality of hermetically sealed enclosures that act as independent lamps. All of the above cited prior art seem irrelevant to the present invention.

SUMMARY OF THE INVENTION

The simple method of this invention for the sensible insertion of fluorescent tube pin connectors into lineal sockets relys on sensible indicators in orientation with the pins. This permits the person installing such devices to sense the orientation of the pins by placing the forefinger and thumb on the sensible indicators located on the tube base, thus orienting the pins for insertion into the lineal socket, then to push the tube into the lineal socket. When further travel into the socket is not possible, to rotate the tube 90° about its axis until locked. In addition to the sensible indicators on the base of the fluorescent tube a similar sensible indicator is placed on the exterior of the lineal socket's housing so that when the tube is rotated 90° one of the sensible indicators located on the fluorescent tube base aligns with the sensible indicator on the lineal socket's housing it is positively locked in and in electrical contact position.

The sensible means may be provided by raised configurations whose surface may be knurled for optimum sensibility.

DESCRIPTION OF THE DRAWING

FIG. 1 illustrates a fluorescent fixture, tube and lineal connectors of the instant invention with the sensible indicators in perpendicular relationship to the pins.

FIG. 1A illustrates a fluorescent fixture, tube and lineal connector of the instant invention with the sensible indicators in horizontal or parallel relationship with the pins.

FIG. 2 is an enlarged fragmentary view of the end of the fluorescent tube of FIG. 1.

FIG. 2A is an enlarged fragmentary view of the end of the fluorescent tube of FIG. 1A.

DETAILED DESCRIPTION

Figure 4:
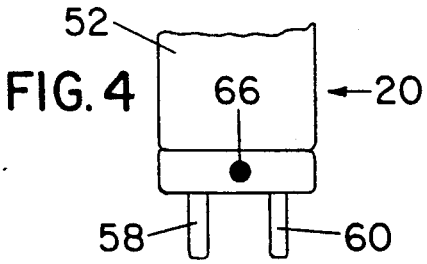
FIG. 4 is a fragmentary view of line 4—4 of FIG. 3.

FIG. 1 illustrates the well known fluorescent tube electrical fixture 24 and fluorescent tube 20. Fixture has a housing 26, a left hand lineal socket member 30 and right hand lineal socket member 28 as well as starter socket member 32 for starter 22 and suitable wiring 36 and connectors 38. Both left and right hand lineal socket members have constricted openings 40 and 46 facing away from housing 26 which are essentially mirror images of each other. Both socket members have spring loaded concave contacts into which pins 62, 64 and 60, 58 must be inserted and rotated 90° to lock into the fixture and to make electrical contact. The pins of fluorescent tube 20 shown in FIG. 1 and FIG. 2 and sensible indicators 66 are located in perpendicular relationship to each other. Similar sensible indicators 27 are located on left and right socket members. When fluorescent tube 20 is inserted into left and right hand socket members and rotated 90° about its axis sensible indicators 66 and 27 align giving a positive indication that fluorescent tube 20 is properly inserted and locked into operating position.

Figure 5:
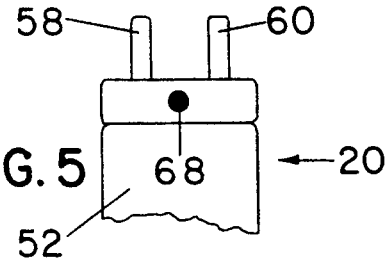
FIG. 5 is a fragmentary view of line 5—5 of FIG. 3.

In this instance the sensible indicators 66 on fluorescent tube ends 54 and 64 are in perpendicular relationship to the pins 58 and 60 the installation method involves placing thumbs on sensible indicators 66 FIG. 1 and 68 FIG. 5 on rear of tube. Pins 58 and 60 are aligned in position for insertion into left and right hand lineal connectors. Thus direct insertion is easily accomplished by pushing oriented pins into lineal connectors. When travel into connectors is restricted, rotating fluorescent tube 90° in either direction to align sensible indicators 66 or 68 on tube end 54 and 64 into alignment with sensible indicator 27 on body of lineal connectors.

FIG. 1A illustrates the positioning of sensible indicators 82 on tube 80 in parallel or horizontal relationship with pins 58 and 60. Also with sensible indicators 29 on lineal connectors 30 and 28. In this instance the method of insertion and locking into connectors consists of grasping the ends of the fluorescent tube 80 with left and right hand thumbs and forefingers so that sensible indicators 82 are directed at the cleft between thumbs and forefingers. The thus grasped fluorescent tube is directed at openings 40 and 46 in lineal connectors. The fluorescent tube 80 is then pushed into connectors 28 and 30. When inward travel is resisted tube 80 is rotated until sensible indicators 82 or 84 FIG. 9 on tube 80 align with sensible indicators 29 on connectors 28 and 30 respectively. Thus effecting a positive lock and secure electrical connection.

Figure 3:
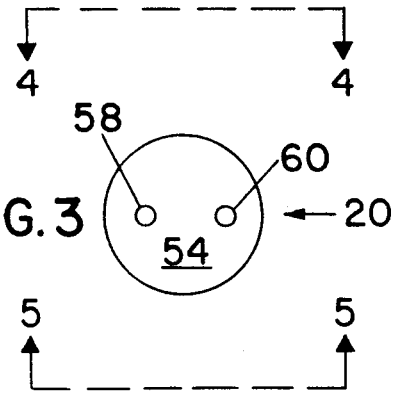
FIG. 3 is an enlarged view of either end of tubes of FIG. 1.

FIGS. 3, 4 and 5 illustrate ends of fluorescent tube 20 showing sensible visible markings 66 on the front of tube and 68 on back of tube wherein sensible indicators 66 and 68 are at 180° to each other but perpendicular to the relationship of pins 58 and 60 (FIG. 1).

Figure 8:
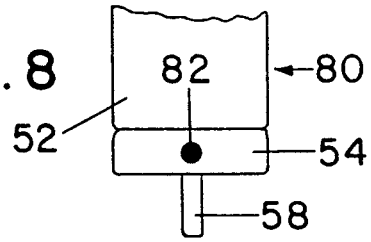
FIG. 8 is a fragmentary view of line 8—8 of FIG. 7.
Figure 7:
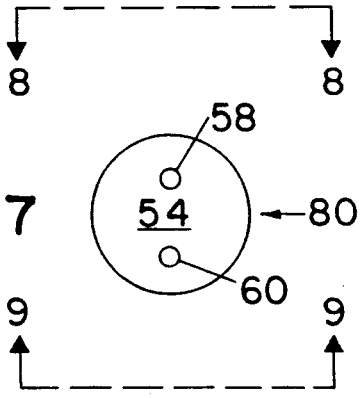
FIG. 7 is a view of the end of a fluorescent tube of FIG. 1A.
Figure 9:
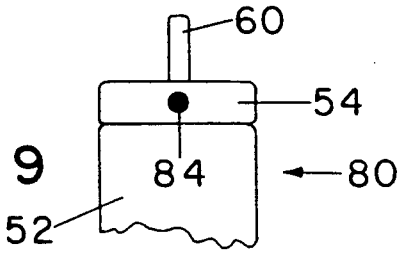
FIG. 9 is a fragmentary view of line 9—9 of FIG. 7.

FIGS. 7, 8 and 9 illustrate the relationship of pins 58 and 60 in tube 80 wherein sensible markings 82 and 84 are in parallel relationship with connector pins 58 and 60 and are spaced at front and back of tube in 180° relationship to each other (FIG. 1A).

Figure 6:
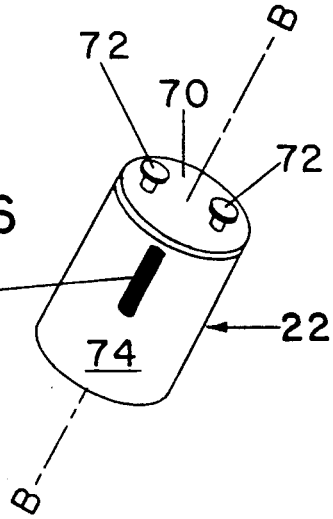
FIG. 6 is a perspective view of the starter of FIG. 1 and FIG. 1A.

FIG. 6 shows a sensible indicator 76 on starter 32 (also shown installed on FIG. 1A) wherein sensible indicator 76 is in perpendicular relationship to pins 72 and 70. On installation of starter 22 into socket 32 in housing 24 it is inserted by pushing into socket (not shown in detail) until further travel is restricted. Starter 22 is then rotated 90° about its axis until sensible indicator 76 on starter 22 aligns with sensible indicator 69 on starter housing 48 thus positively locking starter in place and making positive electrical contact.

It will be appreciated that the invention well attains the stated objects and advantages among others.

The disclosed details are exemplary and are not to be taken as limitations on the invention except as those details are included in the appended claims.

What I claim is:

1. A method for the non-visible orientation of multiple pins of a cylindrical electrical device with pin sockets for ease of installation comprising placing the installer's thumb and forefinger on sensible indicators located on said cylindrical electrical device, grasping said cylindrical electrical device between said thumb and forefinger thereby aligning said pins with said pin sockets, inserting said pins of said electrical device into said pin socket, rotating said cylindrical electrical device about its axis to be captured by retaining mechanism in said pin socket to make electrical contact.

2. A method for the non-visible orientation of multiple pins of a cylindrical electrical device with pin sockets for ease of installation further comprising placing the installer's thumb and forefinger on sensible indicators located on said cylindrical device in perpendicular relationship to said device's pins, grasping said device between said thumb and forefinger thereby aligning said pins of said cylindrical device with said pin socket, inserting said pins of said cylindrical device into said pin socket, rotating said cylindrical electrical device about its axis aligning one of said sensible indicators located on said cylindrical device with a sensible indicator located on said pin socket thereby capturing said pins in said pin socket and making electrical contact.

3. A method for the non-visible orientation of multiple pins of a cylindrical electrical device with pin sockets for ease of installation further comprising placing the installer's thumb and forefinger on sensible indicators located on said cylindrical device in horizontal relationship to said device's pins, grasping said device between said thumb and forefinger thereby aligning said pins of said cylindrical device with said pin socket, inserting said pins of said cylindrical device into said pin socket, rotating said cylindrical electrical device about its axis aligning one of said sensible indicators located on said cylindrical device with a sensible indicator located on said pin socket thereby capturing said pins in said pin socket and making electrical contact.

* * * * *